US007757682B2

(12) United States Patent
Kaminker et al.

(10) Patent No.: US 7,757,682 B2
(45) Date of Patent: Jul. 20, 2010

(54) MAGAZINE ASSEMBLY FOR PRESENTING A PRESSURE CARTRIDGE TO A COMPRESSED GAS POWERED DEVICE

(75) Inventors: Eduard Kaminker, Rochester, NY (US); James M. Martin, Canby, OR (US); David C. Snyder, Palmyra, NY (US); Robert Reifsnyder, Farmington, NY (US)

(73) Assignee: Crosman Corporation, East Bloomfield, NY (US)

( * ) Notice: Subject to any disclaimer, the term of this patent is extended or adjusted under 35 U.S.C. 154(b) by 809 days.

(21) Appl. No.: 11/538,986

(22) Filed: Oct. 5, 2006

(65) Prior Publication Data

US 2008/0168974 A1 Jul. 17, 2008

(51) Int. Cl.
*F41B 11/00* (2006.01)

(52) U.S. Cl. ..... 124/74; 124/71; 124/56

(58) Field of Classification Search ..... 124/61, 124/63, 64, 70–77; 42/16, 50
See application file for complete search history.

(56) References Cited

U.S. PATENT DOCUMENTS

| | | | | | |
|---|---|---|---|---|---|
| 980,980 | A | * | 1/1911 | Maggio | 89/147 |
| 2,881,752 | A | * | 4/1959 | Blahnik | 124/75 |
| 3,048,159 | A | * | 8/1962 | Kline et al. | 124/51.1 |
| 3,077,875 | A | * | 2/1963 | Kline et al. | 124/76 |
| 3,119,384 | A | * | 1/1964 | Merz | 124/76 |
| 3,207,143 | A | * | 9/1965 | Kline et al. | 124/76 |
| 3,212,489 | A | * | 10/1965 | Merz | 124/74 |
| 3,261,341 | A | * | 7/1966 | Merz | 124/74 |
| 3,527,194 | A | | 9/1970 | Vadas et al | |
| 3,788,298 | A | * | 1/1974 | Hale | 124/76 |
| 3,889,652 | A | | 6/1975 | Curtis | |
| 3,999,534 | A | | 12/1976 | Chapin et al. | |
| 4,150,656 | A | | 4/1979 | Curran | |
| 4,344,410 | A | | 8/1982 | Curran | |

(Continued)

OTHER PUBLICATIONS

PCT—Notification of Transmittal of the INternational Search Report and the Written Opinion of the International Searching Authority, or the Declaration; dated Jul. 28, 2008.

*Primary Examiner*—Troy Chambers
*Assistant Examiner*—Jonathan C Weber
(74) *Attorney, Agent, or Firm*—Brian B. Shaw, Esq.; Stephen B. Salai, Esq.; Harter Secrest & Emery LLP

(57) ABSTRACT

A magazine assembly presents a pressure cartridge to a compressed gas powered device, such as a gun, wherein the magazine assembly has a cartridge support biased with respect to a magazine to urge the pressure cartridge to a short (or seated) position, wherein an interlock plate is biased to engage the cartridge support. The bias on the interlock plate is overcome during insertion of the magazine assembly into a magazine chamber, at which point the cartridge support moves relative to the magazine in response to a seated length of the pressure cartridge. The bias on the interlock plate then controls the positioning of the interlock plate to engage the cartridge support and retain the pressure cartridge relative to the magazine assembly. A lever connected to the gun then engages the magazine assembly to translate the magazine assembly relative to the gun and pierce the pressure cartridge.

15 Claims, 6 Drawing Sheets

U.S. PATENT DOCUMENTS 4,539,969 A 9/1985 Saxby
5,000,155 A * 3/1991 Gallagher ..... 124/71
5,160,795 A * 11/1992 Milliman ..... 42/65
5,341,790 A 8/1994 Ebert
5,361,524 A 11/1994 Karkau et al.
5,363,834 A * 11/1994 Stuchlik ..... 124/76
5,400,536 A * 3/1995 Milliman ..... 42/65
5,404,863 A * 4/1995 Poor ..... 124/74
5,476,087 A * 12/1995 Kunimoto ..... 124/73
5,477,843 A * 12/1995 Kunimoto ..... 124/73
5,509,399 A * 4/1996 Poor ..... 124/76
5,586,545 A 12/1996 McCaslin
5,622,160 A 4/1997 Casas Salva
5,711,286 A * 1/1998 Petrosyan et al. ..... 124/73
5,884,615 A * 3/1999 Casas Salva ..... 124/71
6,026,797 A * 2/2000 Maeda et al. ..... 124/74
6,029,645 A 2/2000 Wonisch et al.
6,470,872 B1 * 10/2002 Tiberius et al. ..... 124/74
6,494,194 B2 12/2002 Shipachev et al.
6,637,450 B2 10/2003 Huang
6,701,909 B2 * 3/2004 Tiberius et al. ..... 124/74
6,817,134 B2 11/2004 Newman
6,892,718 B2 * 5/2005 Tiberius et al. ..... 124/74
7,237,543 B2 * 7/2007 Su ..... 124/71
RE39,805 E * 9/2007 Maeda et al. ..... 124/74
7,267,119 B2 * 9/2007 Maeda et al. ..... 124/73
7,290,539 B2 * 11/2007 Maeda et al. ..... 124/74
7,353,815 B2 * 4/2008 Wei ..... 124/45
7,353,816 B2 * 4/2008 Maeda et al. ..... 124/73
7,398,776 B2 * 7/2008 Casas Salva ..... 124/74
7,415,977 B2 * 8/2008 Chen ..... 124/74
2002/0139362 A1 * 10/2002 Shipachev et al. ..... 124/74
2003/0047174 A1 * 3/2003 Tiberius et al. ..... 124/74
2003/0106545 A1 * 6/2003 Verini ..... 124/74
2004/0200466 A1 * 10/2004 Salva ..... 124/74
2004/0200467 A1 * 10/2004 Tiberius et al. ..... 124/74
2005/0188978 A1 9/2005 Tiberius et al.
2006/0112944 A1 * 6/2006 Su ..... 124/71
2006/0162711 A1 * 7/2006 Maeda et al. ..... 124/73
2006/0201491 A1 * 9/2006 Wei ..... 124/74
2007/0028911 A1 * 2/2007 Chen ..... 124/74
2007/0181116 A1 * 8/2007 Wei ..... 124/74
2008/0017180 A1 * 1/2008 Maeda et al. ..... 124/74
2008/0168972 A1 * 7/2008 Wei ..... 124/69

* cited by examiner

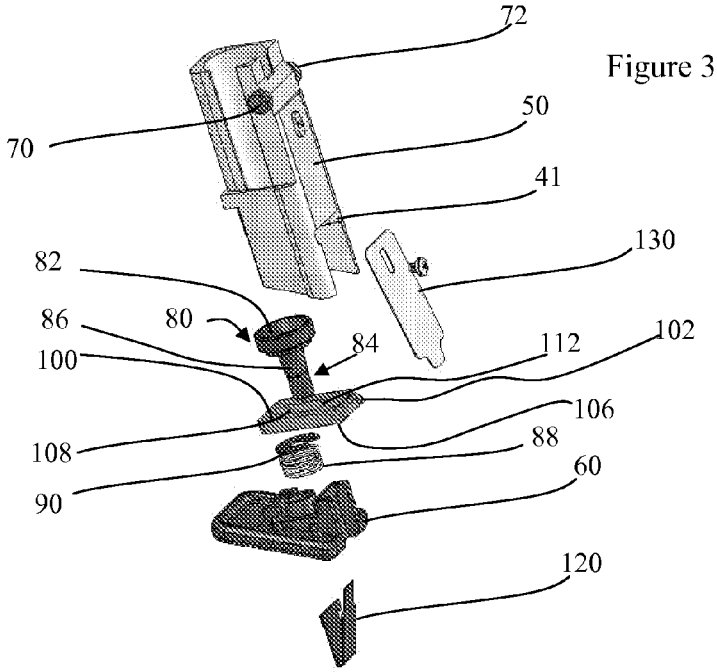
Figure 3
Figure 4
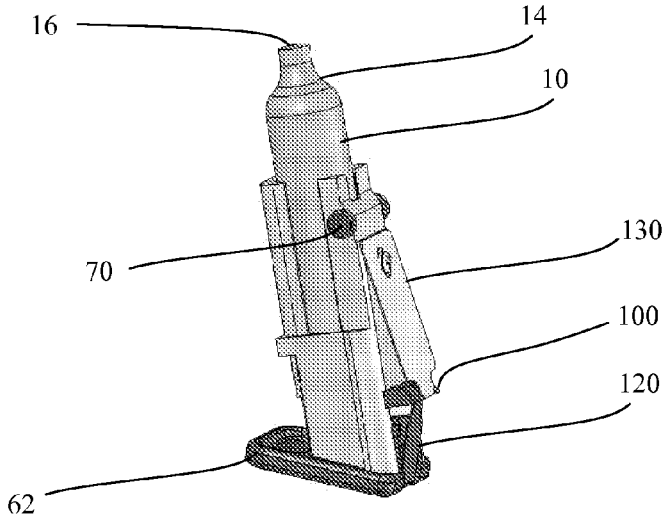

MAGAZINE ASSEMBLY FOR PRESENTING A PRESSURE CARTRIDGE TO A COMPRESSED GAS POWERED DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A "SEQUENCE LISTING"

Not Applicable.

BACKGROUND OF THE INVENTION

1. Field of The Invention

The present invention relates to the presentation of a pressure cartridge to a compressed gas powered device, and more particularly to the presentation of the pressure cartridge to a hand held compressed gas powered device such as a gun.

2. Description of Related Art

Various guns, such as handguns and rifles employ the selective release of a pressurized gas to launch a projectile. In some constructions, the pressurized gas is air which is compressed by the user, such as by a hand actuated pump. In other configurations, a pressurized container is used to retain a supply of pressurized gas. In these latter configurations, the pressurized container must be fluidly connected to the gun so that the pressurized gas can be employed to launch the projectile.

Typical pressurized containers are cylindrical vessels having a rounded closed end and a sealed necked end, wherein the seal is selectively ruptured to expose the pressurized contents. The pressurized containers have a nominal length. However, due to manufacturing processes the container length varies about the nominal dimension. Thus, for example, ASTM standards provide for a 12 gram container to be between 3.058 inches and 3.138 inches in length.

To employ the pressurized contents of the container, the seal must be pierced in a controlled manner. However, the variation in length of the containers requires individual accommodation of each container to operably locate the seal relative to a piercing system.

A prior device for presenting a gas cartridge to a hand-held firearm is set forth in U.S. Pat. No. 4,344,410. In this patent, a grip member includes an outwardly pivotable cover with a deformation into which a gas cartridge is insertable. By closing of the cover, the gas cartridge is brought into a final position in which the upper closure is pushed upwardly through a valve arrangement that is built into the firearm. As a result thereof, the gas is allowed to expand from the gas cartridge and is conducted through the valve system of the firearm for the emission of a projectile.

However, the system of U.S. Pat. No. 4,344,410 does not permit any accommodation for variations in a length of the gas cartridge. The gas cartridge is brought into its final position in a single pivoting movement of the cover, whereby no consideration is given as to whether the gas cartridge has been correctly inserted, whether it possesses the correct precisely-fitted dimensions, and whether it has been canted during the inward pivoting movement of the cover. These occurrences can reduce the firing capacity of the firearm, as well as lead to damaging of the gas cartridge and/or the firearm.

The need remains for a system that can present pressure cartridges to a gun in a repeatable position, wherein variations from a nominal length are accommodated independent of operator adjustment.

BRIEF SUMMARY OF THE INVENTION

The present magazine assembly accommodates, free of operator adjustment, a variance in length of the pressure cartridges so as to maintain a constant, repeated seating of the cartridge relative to a piercing mechanism. The magazine assembly can be employed to present the pressure cartridge to any of a variety of devices, including but not limited to air guns, sprayers, paintball markers, tools and soda machines.

In one configuration, a magazine assembly is provided for presenting a pressure cartridge to a gas powered gun. The magazine assembly includes a magazine having a pressure cartridge receiving sleeve, wherein a cartridge support is biased with respect to sleeve to urge the pressure cartridge support to a short position. An interlock plate is biased to engage the cartridge support. The bias on the interlock plate is overcome during insertion of the magazine assembly into a magazine chamber of the gun, at which time the cartridge support moves relative to the magazine in response to a seated length of the pressure cartridge. Continued insertion of the magazine assembly allows the bias on the interlock plate to then control the positioning of the interlock plate so as to engage the cartridge support and retain the pressure cartridge relative to the gun. A lever connected to the gun then engages the magazine assembly to translate the magazine assembly relative to the gun and pierce the pressure cartridge.

In a further configuration, a magazine assembly is used to present a pressure cartridge to a gun, wherein the magazine assembly includes a magazine having a pressure cartridge receiving sleeve; a cartridge support disposed within the sleeve, the cartridge support moveable between a short position and a long position, the cartridge support being biased toward the short position; and an interlock plate moveably mounted to the magazine between a release position permitting movement of the cartridge support between the long position and the short position, and an engaging position inhibiting movement of the cartridge support from the short position to the long position, the interlock plate being biased toward the engaging position.

The accompanying drawings are included to provide a further understanding of the invention, and are incorporated in and constitute a part of this specification. The drawings illustrate one or more embodiment(s) of the invention, and together with the description serve to explain the principles and operation of the invention.

BRIEF DESCRIPTION OF THE SEVERAL VIEWS OF THE DRAWING(S)

FIG. 3 is an exploded perspective view of the magazine assembly of FIG. 1.

FIG. 4 is a perspective view of the magazine assembly of FIG. 1 retaining a pressure cartridge.

DETAILED DESCRIPTION OF THE INVENTION

Figure 1:
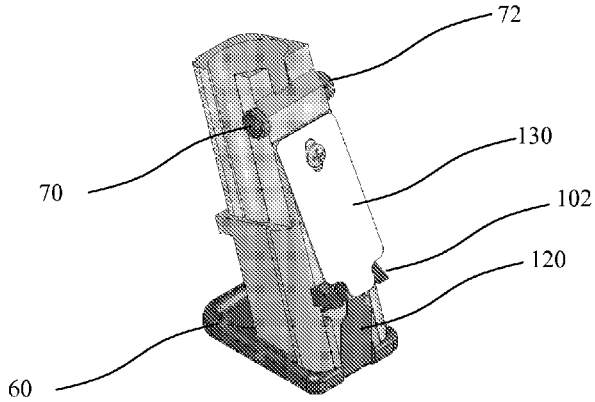
FIG. 1 is a perspective view of the magazine assembly.
Figure 2:
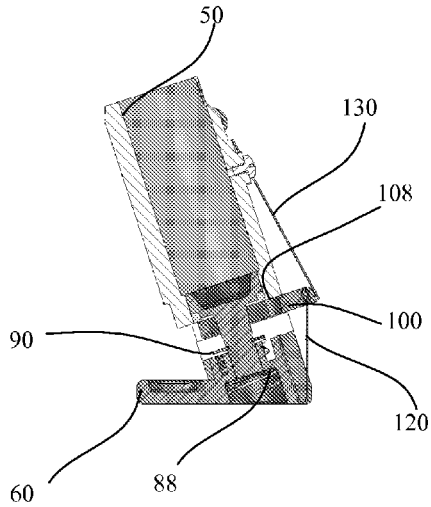
FIG. 2 is a cross-sectional view of the magazine assembly of FIG. 1.
Figure 5:
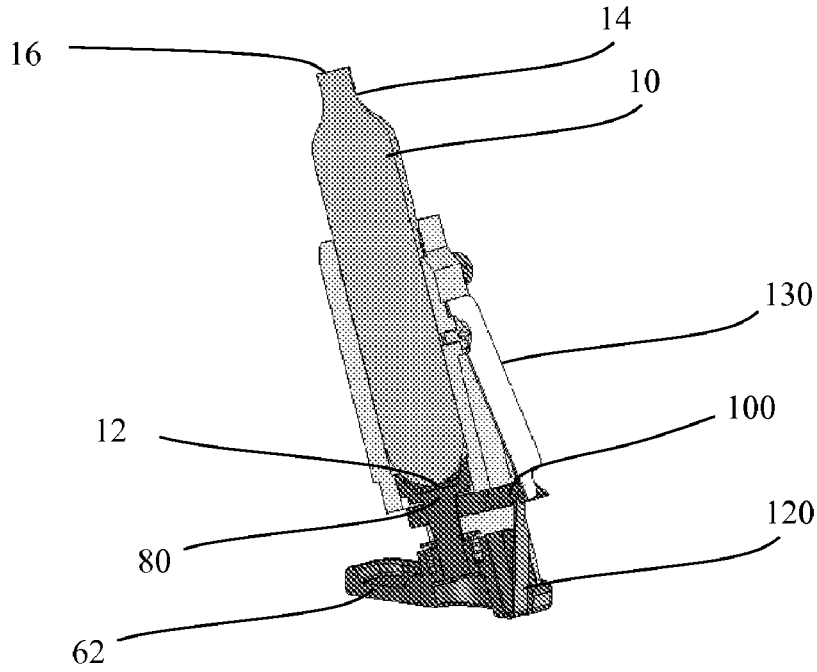
FIG. 5 is a cross-sectional view of the magazine assembly and pressure cartridge of FIG. 4.
Figure 6:
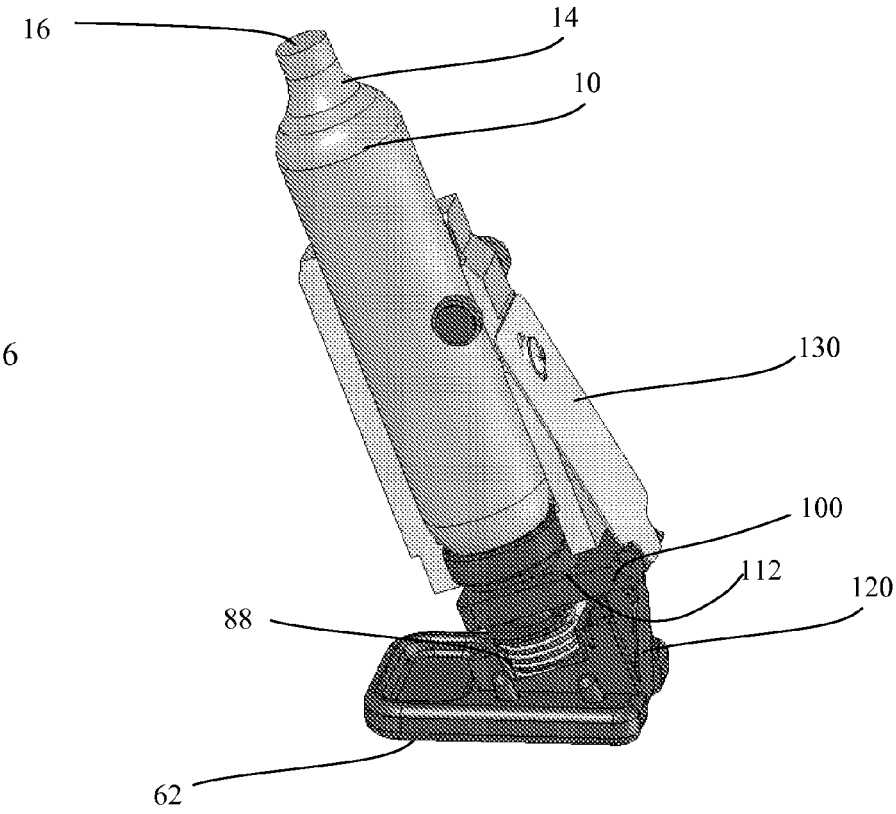
FIG. 6 is a perspective view of the magazine assembly retaining a pressure cartridge, wherein a portion of the magazine assembly is cut away.

The present invention provides for the cooperative engagement of a pressure cartridge 10 and a compressed gas powered device, such as a gun 20. It is understood the compressed gas powered device can be any of a variety of devices, including but not limited to sprayers, paintball markers, inflators, guns, tools as well as soda machines. For proposes of description, the present disclosure is set forth in terms of the compressed gas powered device configured as a gun. It is not intended this specific configuration limit the scope of the invention.

The pressure cartridge 10 is operably retained and aligned with the gun 20 so that pressurized gas from the cartridge is selectively passed through the gun to provide a motive force for the gun.

The term pressure cartridge 10 is used to encompass any of a variety of sealed pressurized containers retaining a volume of pressurized gas, wherein the seal is selectively punctured to expose the retained pressurized gas to the gun for providing a motive force for projectiles. The pressurized gas can include, but is not limited to air, carbon dioxide or nitrogen, as well as mixtures of gases. The term pressure cartridge 10 is intended to encompass cylinders, capsules, containers, bottles or cartridges. The pressure cartridge 10 has a generally cylindrical shape including a rounded closed end 12 and a necked end 14, wherein a seal 16 extends across the necked end.

Although the gun 20 shown in the accompanying figures is a handgun, the present invention is not limited to handguns and can be employed for any gun, such as a rifle, handgun or paintball marker, employing a pressurized gas from the pressure container to launch a projectile.

Figure 7:
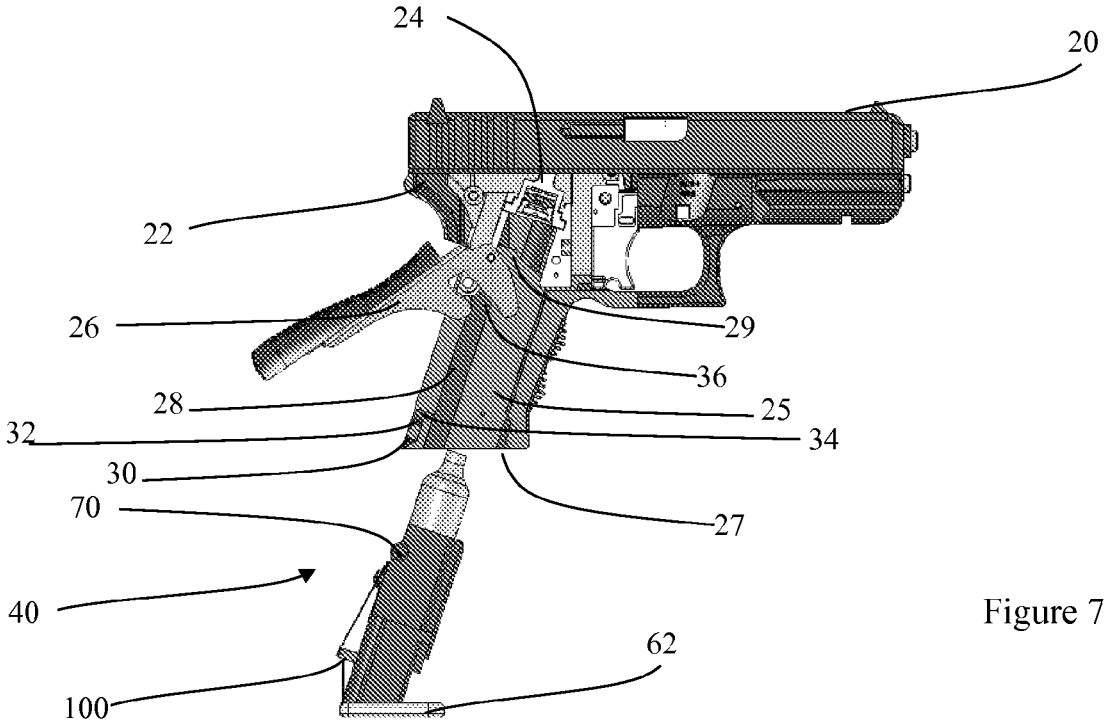
FIG. 7 is a side elevational, partial cross-sectional view showing operable alignment of the magazine assembly retaining a pressure cartridge and a gun.
Figure 8:
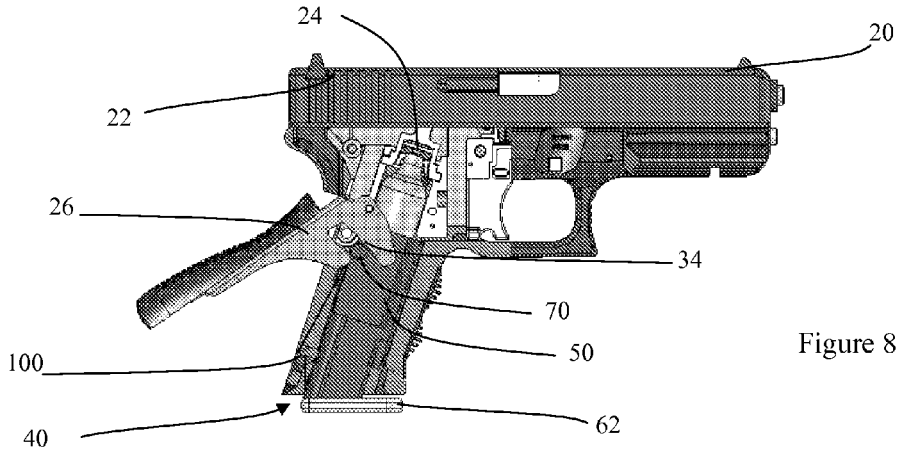
FIG. 8 is a side elevational partial cross-sectional view showing insertion of the magazine assembly and pressure cartridge into a magazine chamber.
Figure 9:
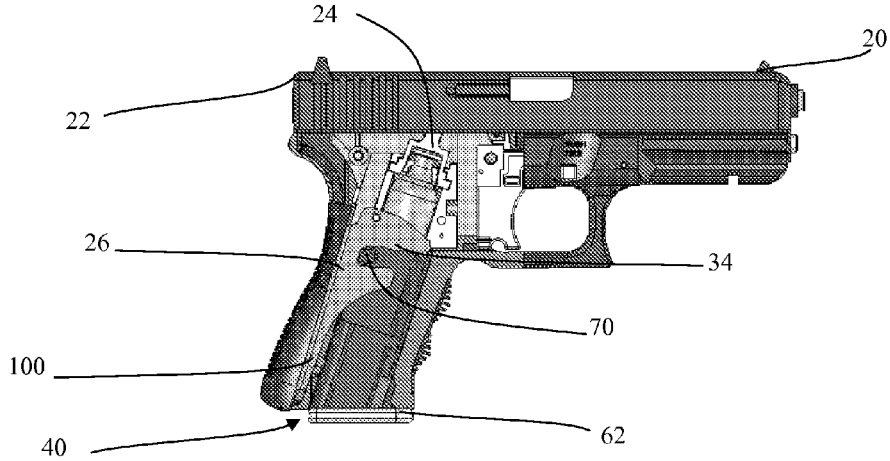
FIG. 9 is a side elevational partial cross-sectional view showing the magazine assembly and a pressure cartridge in a pierced and operable position.

As seen in FIGS. 7-9, the gun 20 includes a frame 22 having a piercing mechanism 24, a magazine chamber 25 and an operating lever 26.

The piercing mechanism 24 can be any of a variety of systems currently known in the art including hollow pin and solid pin systems. For purposes of description, the piercing pin and associated face seal are described in terms of operable engagement with the pressure cartridge 10. Any associated valving mechanism for selectively exposing the pressurized gas to a projectile in the gun 20 is well-known and does not form a part of the present invention. In alternative constructions, the piercing mechanism 24 can be incorporated into the magazine assembly.

The frame 22 can have any of a variety of configurations and constructions. For example, the frame 22 can be formed of mating halves, castings, moldings or a machined parts, or a combination thereof. The frame 22 can be configured to locate the magazine chamber 25 at any of a variety of locations. Thus, in the configuration of the compressed gas powered device being the gun 20, the magazine chamber 25 can be disposed along the fore end of the stock or the stock, the grip. For purposes of illustration, the magazine chamber 25 is located within a grip of a handgun 20.

The magazine chamber 25 has an open end 27 and a generally closed end 29 within the frame 22. The closed end 29 of the magazine chamber 25 includes or operably locates the piercing mechanism 24. The magazine chamber 25 includes a pair of longitudinally extending channels 28. A catch 30 extends into the magazine chamber. The catch 30 defines an inclined or ramp surface 32 exposed to the open end 27 of the magazine chamber 25 and a shoulder or stop 34, exposed to the closed end 29 of the magazine chamber.

The lever 26 is pivotally connected to the frame 22 and movable between an open position shown in FIGS. 7 and 8, and a closed position shown in FIG. 9. In one configuration, the lever 26 includes a cam track 36, having specific profile to seat, pierce and retain the pressure cartridge 10 relative to the piercing mechanism 24 (and the frame 22). The lever 26 and the cam track 36 are configured to intersect the cam track with the longitudinally extending channels 28.

A magazine assembly 40 is employed for retaining and presenting the pressure cartridge 10 to the gun 20. The magazine assembly 40 includes an elongate pressure cartridge receiving sleeve 50, a base 60, a pair of projecting bosses 70, a cartridge support 80 and an interlock plate 100. The magazine assembly 40 further includes a slot 41 extending generally transverse to the elongate sleeve 50.

Referring to FIGS. 4-9, the elongate sleeve 50 receives a length of the pressure cartridge 10 including the closed end 12 of the cartridge. The necked end 14 and the seal 16 of the pressure cartridge 10 extend beyond the elongate sleeve 50. As seen in FIG. 3, the base 60 is cooperatively engaged with the elongate sleeve 50. The base 60 includes a projecting flange 62 for overlying an adjacent portion of the frame 22 upon operably engagement of the magazine assembly 40 with the frame.

The projecting bosses 70 of the magazine assembly 40 are located and sized to be slideably received within the corresponding longitudinal channels 28 of the magazine chamber 25. In one configuration, each boss 70 includes a bushing 72 for assisting translation of the bosses relative to the lever 26, as well as a rotational movement relative to the bosses.

The cartridge support 80 is disposed within the elongate sleeve 50 to be moveable along a longitudinal dimension of the sleeve, between a short position and a long position, wherein the short position accommodates the shortest length of the pressure cartridge 10 and the long position accommodates the greatest length of the pressure cartridge. The travel distance of the cartridge support 80 between the long position and the short position is selected to accommodate the anticipated variance in length of the pressure cartridges 10. The cartridge support 80 contacts the closed end 12 of the pressure cartridge 10. The cartridge support 80 includes a head 82 sized to contact the closed end 12 of the pressure cartridge 10. The head 82 can be any of a variety of configurations including a concave recess sized to receive the closed end 12 of the pressure cartridge 10. A stem 84 projects from the head 82 and in one configuration, defines a tapered length 86. The taper 86 defines an angle between approximately 1° and approximately 45°, and has a length of approximately one half inch. In one configuration, the taper is approximately 10° to 25°.

The cartridge support 80 is biased toward the open end of the elongate sleeve 50. The bias on the cartridge support can be provided by any of a variety of configurations including helical springs, torsion springs, leaf springs and coil springs. In one configuration, as seen in FIGS. 2, 3, 5 and 6, a retaining clip, or e-ring 90 is engaged with the stem 84, wherein a helical spring 88 is disposed between the base 60 and the clip 90 to bias the cartridge support 80 to the short position.

The interlock plate 100 is slideably disposed within the slot 41 in the magazine assembly 40, and is moveable between a locking position and a release position. In one configuration, the interlock plate 100 includes at least one tooth 102 that extends beyond the slot 41 to terminate at a spaced location from an adjacent portion of the sleeve 50. The tooth 102 has a ramp surface 104 facing upward (towards the open end of the sleeve 50) and a shoulder, or stop 106, facing downward (towards the closed end of the sleeve). In an alternative configuration, the tooth 102 can be recessed with respect to an adjacent portion of the magazine assembly 40, wherein the frame 22 includes a corresponding projection sized to cooperatively engage the tooth.

The interlock plate 100 includes a keyway 110, wherein a periphery of the keyway defines a narrowing opening. That is, the keyway 110 includes a bulbous portion 112 and a constricting (throat) portion 114. As seen in FIG. 3, the keyway 110 extends through the thickness of the interlock plate 100. Further, in one configuration, the keyway periphery defines a taper 108 from an upper surface of the interlock plate to a bottom surface of the interlock plate. Thus, the periphery of the keyway 110 at the upper surface of the interlock plate 100 is slightly larger than the periphery of the keyway at the bottom surface of the interlock plate. The taper 108 in the periphery of the keyway 110 is selected to cooperate with the taper 86 of the stem 84, such that upon contact, the taper of the keyway and the taper of the interlock plate 100 tend to bind or lock together. In one configuration, the interlock plate 100 has a thickness of approximately 0.2 inches, wherein the taper through the thickness of the interlock plate is between approximately 1° and approximately 45°, and more specifically approximately 10° to 25°. The bulbous portion 112 of the keyway 110 is sized to slideably receive the stem 84 and the throat portion 114 including the taper 108 is sized to engage the stem.

In a further configuration, the keyway 110 can be formed without the taper, wherein at least one of the cartridge support 80 and the keyway includes a surface feature such as a rib, flute or knurl. Alternatively, at least one of the cartridge support 80 and the keyway 110 can include at least one step or shoulder, having a smaller dimension towards the base 60.

The interlock plate 110 is biased out of, or away from the elongate sleeve 50, toward the locking position. As seen in FIGS. 1-6, the bias on the interlock plate 100 is applied by a leaf spring 120 connected to the base 60 and extending to engage an aperture in the interlock plate 100. The interlock plate 100 is thus movable within the slot 41 between the locking position as urged by the bias and the release position that is against the bias. The magazine assembly 40 is constructed such that the stem 84 of the cartridge support 80 passes through the keyway 110 of the interlock plate 100. The bias on the cartridge support 80 urges cartridge support to the short position, and the bias on the interlock plate 100 urges the keyway 110 to engage the taper 86 of the stem 84.

A release tab 130 is connected to the elongate sleeve 50 and extends over a portion of the interlock plate 100 that projects beyond an adjacent portion of the sleeve. The release tab 130 is movable between an engaged position and a release position. In the engaged position, the release tab 130 rests upon the interlock plate 100, with the interlock plate in the locking position. In the release position of the release tab 130, the tab has moved to urge the interlock plate 100 against the interlock bias of spring 120.

In a further configuration, the release tab 130 can be sized to contact the recessed tooth 102 to move the interlock plate 100 to the release position.

In operation, the pressure cartridge 10 is disposed within the magazine assembly 40 such at the closed end 12 of the cartridge is seated on the cartridge support 80. The cartridge support bias (spring 88) urges the cartridge support 80 to the short position and the interlock bias (spring 120) urges the interlock plate 100 toward the locking position.

The magazine assembly 40 is then loaded into the magazine chamber 25, by disposing the necked end 14 of the pressure cartridge 10 within the magazine chamber 25. As the magazine assembly 40 is introduced into the magazine chamber 25, the bosses 70 are aligned with the corresponding channels 28 in the chamber. The magazine assembly 40 is then slid into the magazine chamber 25 , with the lever 26 in the open position, until the ramp 104 of the interlock plate 100 engages the corresponding the ramp 32 on the catch 30 of the frame 22. Continued insertion of the magazine assembly 40 into the magazine chamber 25 causes the ramps 104, 32 to move the interlock plate 100 to the release position, thereby allowing vertical translation of the cartridge support 80 against the bias on the cartridge support.

As the ramp surfaces 104, 32 are at the point of bypassing, the seal 16 of the pressure cartridge 10 abuts against the piercing mechanism 24 (assumes a seating position) in the frame 22. That is, the seal 16 or necked end 14 the pressure cartridge 10 generally seats or abuts a portion of the frame 22 or the piercing mechanism.

Just prior to the interlock plate 100 bypassing the catch 30, the pressure cartridge 10 assumes the necessary operable pre-piercing position (or seating position) with respect to the piercing mechanism 24, and the interlock plate allows the cartridge support 80 to vertically translate to the appropriate position. Thus, if the pressure cartridge 10 is relatively long, the cartridge support 80 moves against the bias of the helical spring 88 towards the base 60. Alternatively, if the pressure cartridge 10 is relatively short, the cartridge support 80 moves with the bias of the spring 88 (the pressure cartridge bias) towards the open end of the elongate sleeve 50. The cartridge support 80 thereby assumes a seating position, wherein the seal 16 of the pressure cartridge 10 is operably located prior to piercing.

Upon continued insertion of the magazine assembly 40 into the magazine chamber 25, the ramp surfaces 104, 32 bypass each other and the bias on the interlock plate 100 forces the interlock plate to the locking position, wherein the taper of the keyway 110 and the taper 86 of the stem 84 engage and bind, thereby fixing the position of the cartridge support 80, and hence pressure container 10 relative to the magazine assembly 40. In the alternative constructions, the surface features or steps engage to fix the position of the cartridge support 80, and hence pressure container 10 relative to the magazine assembly 40. In those constructions employing the tapers or knurls, the available positioning of the cartridge support 80 relative to the interlock plate 100 (and hence pressure cartridge 10 to the magazine assembly 40, and frame 22) is substantially continuous, in that any position of the cartridge support can result in locking engagement with the interlock plate 100. In the construction employing the steps, the positioning of the cartridge support 80 relative to the interlock plate 100 is incremental, wherein the incremental step size can be selected to accommodate the anticipated sizing of the pressure cartridge 10.

As cartridge support 80 has moved against (or with) the bias to accommodate the closed end 12 of the pressure cartridge 10 and the interlock plate 100 has engaged the cartridge support to fix the cartridge support with respect to the given pressure cartridge length, the position of the pressure cartridge relative to the piercing mechanism 24 is set. Therefore, the seal 16 of the pressure cartridge 10 is in a predetermined and repeatable location with respect to the piercing mechanism 24.

The lever 26 is then moved from the open position such that the cam track 36 engages the projecting bosses 70, as the bosses are within the channels 28 in the magazine chamber 25. Further rotation of the lever 26 causes the cam track 36 to move the bosses 70 (and hence magazine assembly 40 and retained pressure cartridge 10) relative to the piercing mechanism 24. As the taper 108 of the keyway 110 of the interlock plate 100 binds with the taper 86 of the cartridge support 80, movement of the magazine assembly 40 results in a corresponding movement of the pressure cartridge 10. The seal 16 of the pressure cartridge 10 is thus moved against the piercing mechanism 24 to pierce the seal. Upon full rotation of the lever 26 to the closed position, the cam track 36 defines a slight overthrow such that the face seal between the compression. pressure cartridge 10 and the frame 22 is at a generally predetermined Further, in the closed position of the lever 26, the magazine assembly 40 is drawn into the magazine chamber 25 so that the base 60 is generally adjacent or abutting the frame 22.

Upon rotating the lever 26 from the closed position to the open position, the magazine assembly 40 is translated along the magazine chamber 25 and the face seal between the pressure cartridge 10 and the frame 22 is broken, thereby allowing venting of any remaining pressurized gas from the pressure cartridge 10.

Continued withdrawal of the magazine assembly 40 from the magazine chamber 25 causes the shoulder (stop) 106 of the interlock plate 100 and the shoulder (stop) 34 of the catch 30 to engage, thereby substantially precluding complete withdrawal of the magazine assembly from the frame 22. The contact of the interlock stop 106 and the catch stop 34 reduces the possibility of the magazine assembly 40 being ejected from the gun 20 upon the degassing of a retained pressure cartridge 10.

To remove the magazine assembly 40 from the frame 22, the release tab 130 is depressed thereby urging the interlock plate 100 to the release position, thereby allowing the interlock plate and magazine assembly to bypass the stop 34 of the catch 30. The magazine assembly 40 is then fully withdrawn allowing the bosses 70 to pass from the corresponding channels 28.

The cartridge support 80 of the present construction accommodates the different lengths of the pressure cartridges 10, so that the position of the bosses 70 (and hence magazine assembly 40 and seal 16 of the pressure cartridge 10), is consistent with respect to the frame 22 and piercing mechanism 24, independent of the length of the pressure cartridge. That is, the lever 26 (and cam track 36) act to impart the same motion and force between the pressure cartridge 10 and the piercing mechanism 24 independent of the length of the pressure cartridge.

Alternatively stated, the magazine assembly 40 accommodates variations in the length of the pressure cartridge 10 by adjusting and then maintaining the position of the cartridge support 80, so that the seal 16 of the pressure cartridge is located in a common position, independent of a variation from nominal length, so that a constant piercing force is applied to the pressure cartridge, independent of the length of the pressure cartridge.

Although the description is set forth in terms of the magazine assembly 40 moving relative to the frame 22 (and piercing mechanism 24), it is contemplated that upon insertion of the magazine assembly into the frame, the magazine assembly is then fixed and the piercing mechanism is moved. In such configuration, the magazine assembly 40 again accommodates for variations in the length of the pressure cartridge 10, and the movement of the piercing mechanism 24 results in a constant relative motion, piercing force and sealing force with the pressure cartridge 10.

Further, in an alternative configuration, the lever 26 can be connected to the magazine assembly 40, such as the pressure cartridge sleeve 50, wherein the frame 22 includes the bosses 70, such that upon setting the cartridge support 80 relative to the interlock plate 100, the lever 26 on the magazine assembly is moved to engage the bosses on the frame and pierce the pressure cartridge.

Although the present invention has been described in terms of particular embodiments, it is not limited to these embodiments. Alternative embodiments, configurations or modifications which will be encompassed by the invention can be made by those skilled in the embodiments, configurations, modifications or equivalents may be included in the spirit and scope of the invention, as defined by the appended claims

The invention claimed is:

1. A magazine assembly for presenting a pressure cartridge to a compressed gas powered device, the magazine assembly comprising: (a) a receiving sleeve for a compressed gas cartridge, the sleeve defining a longitudinal axis; (b) a cartridge support disposed within the sleeve, the cartridge support moveable along the longitudinal axis between a short position and a long position; (c) a biasing member biasing the cartridge support toward the short position; (d) an interlock plate disposed between the biasing member and the cartridge support, the interlock plate moveable toward and away from the longitudinal axis of the sleeve, the interlock plate moveable between a release position permitting movement of the cartridge support between the long position and the short position, and an engaging position inhibiting movement of the cartridge support from the short position to the long position, and (e) a second biasing member biasing the interlock plate toward the engaging position.

2. The magazine assembly of claim 1, further comprising:

(a) a device frame having a magazine chamber, the magazine chamber sized to slideably receive the magazine assembly; and (b) a lever connected to the frame and moveable between a loading position and a piercing position, the lever engaging the magazine assembly in the piercing position.

3. The magazine assembly of claim 2, wherein the lever includes a cam track.

4. The magazine assembly of claim 2, wherein the device frame includes one of a grip, a stock and fore end, the one of the grip, the stock and the fore end encompasses the magazine chamber.

5. The magazine assembly of claim 2, further comprising a piercing pin fixed relative to the device frame, the piercing pin contacting a pressure cartridge when the magazine assembly is inserted in the frame.

6. The magazine assembly of claim 1, wherein the interlock plate includes a keyway defining a cartridge support engaging surface.

7. The magazine assembly of claim 1, wherein the cartridge support includes a projecting stem, the projecting stem sized to contact the interlock plate in the engaging position of the interlock plate.

8. The magazine assembly of claim 1, wherein the cartridge support includes a seat for contacting a portion of the pressure cartridge.

9. The magazine assembly of claim 1, wherein the interlock plate includes a keyway defining a cartridge support engaging surface, the keyway having a taper across a thickness of the interlock plate.

10. The magazine assembly of claim 1, wherein in the engaging position of the interlock plate, a portion of interlock plate projects from an adjacent portion of the magazine assembly.

11. The magazine assembly of claim 1, further comprising a release tab contacting a portion of the interlock plate, the release tab moveable between a loaded position and a release position.

12. A method for presenting magazine assembly having a pressure cartridge to a compressed gas powered device, the method comprising:

(a) providing a first biasing member and biasing a cartridge support within a receiving sleeve for a compressed gas cartridge of the magazine assembly, the cartridge support moveable along a longitudinal axis of the sleeve between a short position and a long position, the cartridge support biased toward the short position; and (b) providing a second biasing member and biasing an interlock plate moveably mounted to the magazine assembly between a release position permitting movement of the cartridge support between the long position and the short position, and an engaging position inhibiting movement of the cartridge support from the short position to the long position, toward the engaging position, wherein the interlock plate is moveable toward and away from a longitudinal axis of the sleeve.

13. The magazine assembly of claim 1, the cartridge support including a projecting stem passing through the interlock member.

14. A magazine assembly for presenting a pressure cartridge to a compressed gas powered device, the magazine assembly comprising: (a) a receiving sleeve for a compressed gas cartridge, the sleeve defining a longitudinal axis; (b) a cartridge support disposed within the sleeve, the cartridge support moveable along the longitudinal axis between a short position and a long position; (c) a biasing member biasing the cartridge support toward the short position; (d) an interlock plate moveable toward and away from the longitudinal axis of the sleeve, the interlock plate moveable between a release position permitting movement of the cartridge support between the long position and the short position, and an engaging position inhibiting movement of the cartridge support from the short position to the long position, and (e) a second biasing member biasing the interlock plate toward the engaging position, the interlock plate engaging the cartridge support in the engaging position.

15. A magazine assembly for presenting a pressure cartridge to a compressed gas powered device, the magazine assembly comprising: (a) a receiving sleeve for a compressed gas cartridge, the sleeve defining a longitudinal axis; (b) a cartridge support disposed within the sleeve, the cartridge support moveable along the longitudinal axis between a short position and a long position; (c) a biasing member biasing the cartridge support toward the short position; (d) an interlock plate moveable toward and away from the longitudinal axis of the sleeve, the interlock plate moveable between a release position permitting movement of the cartridge support between the long position and the short position, and an engaging position inhibiting movement of the cartridge support from the short position to the long position, and (e) a second biasing member biasing the interlock plate toward the engaging position, the interlock plate and at least a portion of the cartridge support being disposed at a common position along the longitudinal axis.

* * * * *